US005364090A

United States Patent [19]

Hollis et al.

[11] Patent Number: 5,364,090

[45] Date of Patent: Nov. 15, 1994

[54] SEQUENCE STACKER

[75] Inventors: Jeffrey C. Hollis; Chad Bones, both of Modesto; Troy M. York, Manteca, all of Calif.

[73] Assignee: Tab Products Company, Turlock, Calif.

[21] Appl. No.: 94,743

[22] Filed: Jul. 22, 1993

[51] Int. Cl.[5] ..... B65H 29/66

[52] U.S. Cl. ..... 271/216; 271/198

[58] Field of Search ..... 271/213, 216, 198, 199, 271/201, 151; 198/418.9; 414/788.1, 790.7

[56] References Cited

U.S. PATENT DOCUMENTS

| | | | |
|---|---|---|---|
| 3,700,232 | 10/1972 | Wiegert et al. | 271/216 |
| 3,842,719 | 10/1974 | Fernadez-Rama et al. | 271/216 |
| 3,945,635 | 3/1976 | Marin | 271/216 |
| 3,974,626 | 8/1976 | Getsch | 271/216 |
| 4,240,539 | 12/1980 | Klapp | 271/216 |
| 4,928,942 | 5/1990 | Aiuola et al. | 271/216 |

*Primary Examiner*—H. Grant Skaggs
*Attorney, Agent, or Firm*—Donald Cayen

[57] ABSTRACT

A sequence stacker edge stacks envelopes or the like. Belts carry shingled envelopes in a downstream direction to an angled stop. The belts are carefully spaced vertically above a deck. As a stack of envelopes forms against the stop, the weight of the stack deflects the belts until the top surfaces of the belts become aligned with a stationary surface. At that point, the weight of the stack is transferred from the belts to the stationary surface. Consequently, the downstream driving force of the belts on the envelopes' bottom edges is greatly reduced. The result is that the sequence stacker can stack many more envelopes without backward tipping of the envelopes than prior stacking machines. In an alternate design, certain portions of a stack remain urged downstream at all times by the belts. For that purpose, short spacers are placed at intervals under the belts. The short spacers prevent full deflection of the belts' top surfaces into alignment with the stationary surface, so that the weight of the portions of the stack over the short spacers is not transferred to the stationary surface. The belts therefore continuously exert a downstream driving force on the portions of the stack located over the short spacers.

10 Claims, 4 Drawing Sheets

FIG. 4
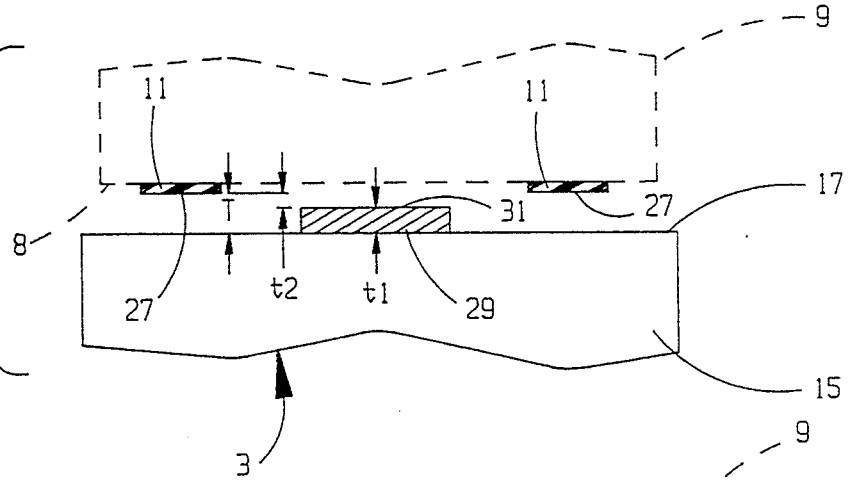
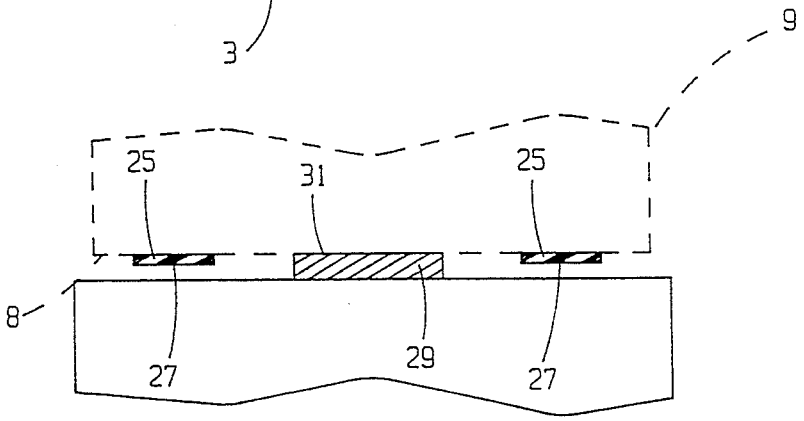
FIG. 5
FIG. 6
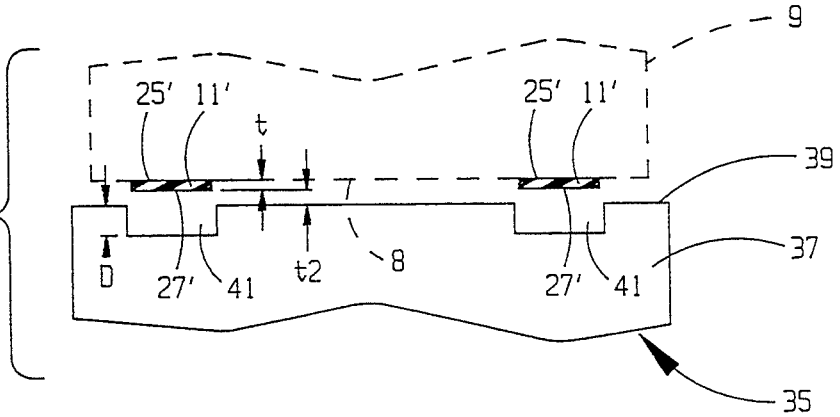
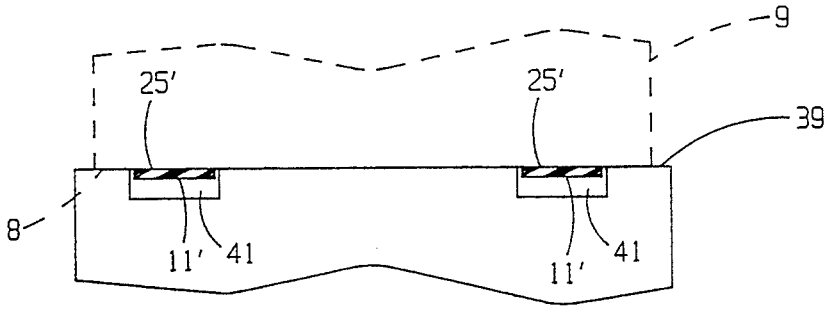
FIG. 7

FIG. 11
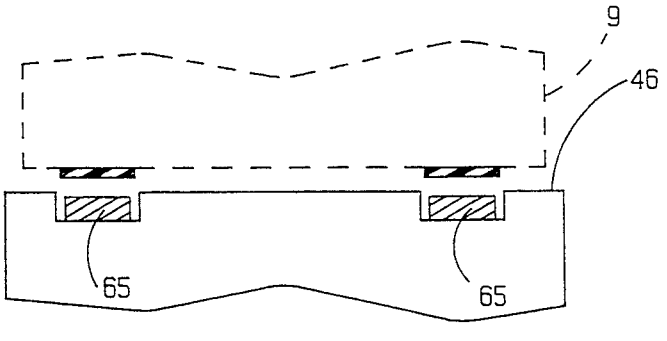
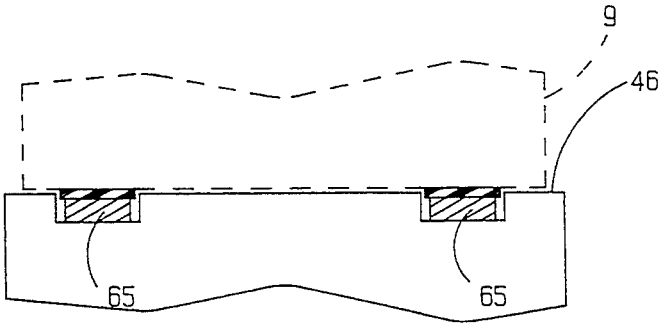
FIG. 12
FIG. 13
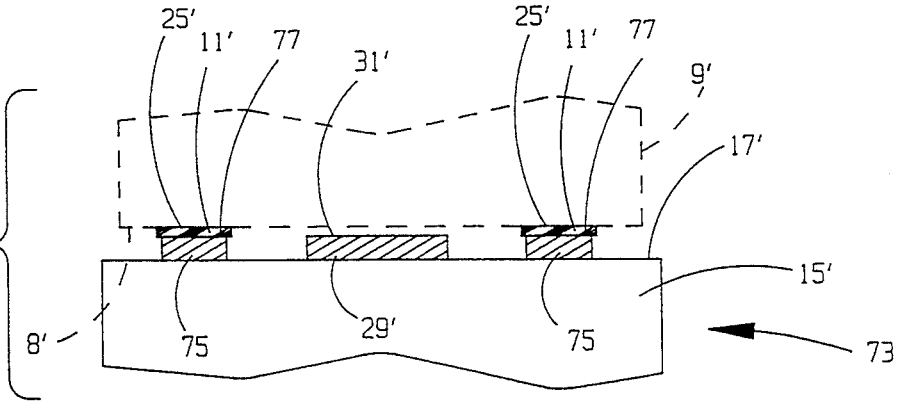

SEQUENCE STACKER

BACKGROUND OF THE INVENTION

1. Field of the Invention

This invention pertains to document handling, and more particularly to apparatus for transporting and stacking envelopes.

2. Description of the Prior Art

Various equipment has been developed to print documents, fold them, and stuff them into envelopes. Additional equipment prints addresses and bar codes on the envelopes in preparation for franking and mailing. Such equipment is highly automated and is capable of handling large volumes of documents at low cost.

A vital component of a document handling system is a stacking machine that edge stacks the stuffed and addressed envelopes. The stacking machines are usually designed with two or more horizontally moving belts. Completed envelopes fall onto the belts from an upstream station, such as an addressing machine, in generally horizontal but overlapped fashion. The belts carry the envelopes to an angled stop at the downstream end of the stacking machine. The leading edge of the first envelope of a batch slides up against the stop under the impetus of the driving friction between the belts and the envelope's trailing or bottom edge, and the stop prevents further downstream motion of the envelope. Subsequent envelopes slide up against the respective adjacent preceding envelopes to form an angled stack.

As more envelopes are added to the stack, the upstream envelopes tip slightly backwardly, i.e., in the upstream direction. Backward tipping is caused by the combination of the compressibility of the envelopes and the constant driving force on their bottom edges by the belts. Ultimately, the stack attains a length such that the upstream envelopes therein tip completely backwardly onto the belts. At that point, the envelopes become disorganized and operation of the stacking machine must halt.

Examples of prior envelope stacking machines may be seen in U.S. Pat. Nos. 2,554,578; 3,817,516; 5,064,185; and 5,137,415. In a typical commercially available stacking machine, four belts have respective upper runs that slide along a deck that is between approximately two and four feet long. About 300 envelopes can be stacked by the prior machine before failure in the form of backward tipping occurs.

In addition to the relatively small number of envelopes they can stack successfully, the prior stacking machines have two other deficiencies. First, the continuously moving belts scuff the bottom edges of the envelopes in the stack. Second, the weight of the stacked envelopes on the belts causes friction between the belts and their underlying support surface. That friction may be sufficient to stall the belt driving motor, so undesirably large motors are often incorporated into the stacking machines.

Thus, a need exists for improvements in envelope stacking machines.

SUMMARY OF THE INVENTION

In accordance with the present invention, a sequence stacker is provided that is capable of edge stacking larger numbers of documents than prior stacking machines. This is accomplished by apparatus that transfers the weight of the stacked documents from driving belts to a stationary support surface.

The sequence stacker comprises a deck having a flat horizontal surface and upstream and downstream ends. Two or more belts have respective upper runs that extend between the deck upstream and downstream ends. Each belt has a thickness defined by a belt top surface and a bottom surface. The top surfaces of the belts are spaced a first distance above the deck. The belts are driven by appropriate motors and pulleys such that the belts' upper runs move in the downstream direction. An angled stop is located at the downstream end of the deck.

The stationary support surface is in the form of one or more long thin spacers attached to the deck surface adjacent the belts. The number and location of the spacers are determined by the number and location of the belts. In all cases, the spacer has an upper surface that lies in a plane located between the deck surface and the top surfaces of the belts. The thickness of the spacer is greater than the thickness of the belts.

In operation, the belts of the sequence stacker carry horizontally shingled documents, such as envelopes, in the downstream direction toward the angled stop. The stop halts downstream motion and simultaneously tilts the envelopes to an angle above the horizontal, with the envelopes' bottom edges being constantly urged downstream by the belts. As the number of envelopes builds up in a stack against the stop, the weight of the envelopes causes the belts under the stack to deflect. Eventually, the weight of the stack causes the belts to deflect to the point where the plane of their top surfaces becomes aligned with the plane of the spacer upper surface. At that point, the stack becomes supported by the spacer and not by the belts. The belts pass under the envelope bottom edges with essentially no contact with them. Consequently, the friction force from the belts that tend to drive the envelopes' bottom edges downstream practically disappears. The portion of the belts upstream from the stack does not deflect to the extent of the deflection under the stack. The belts upstream of the stack are thus able to carry incoming envelopes to the stack in normal fashion. The incoming envelopes push against the downstream envelopes in the stack, but the bottom edges of the envelopes in the stack are not themselves urged downstream by the belts.

As more envelopes bunch up on the stack upstream end, the length of the belts' deflected portion increases proportionally. In that manner, the weight of the ever lengthening stack is always borne by the spacer. The result is that the tendency of the envelopes to tip backwardly upstream is greatly reduced.

In a modified embodiment of the invention, the deck upper surface is fabricated with a shallow groove under each belt. The depth of the groove is greater than the belt thickness. The plane of the top surfaces of the undeflected belts is normally a short distance above the deck surface. With few envelopes on the belts, the belts carry the envelopes downstream in normal fashion to an angled stop. However, as a stack of envelopes builds up against the stop, the weight of the stack causes the belts to deflect into the grooves until the belts' top surfaces are aligned with the deck surface. The weight of the envelopes in the stack is thus transferred to the deck. The undeflected portion of the belts upstream of the stack enables the belts to carry incoming envelopes downstream to the stack in the normal manner.

Further in accordance with the present invention, the sequence stacker is capable of tightly packing long stacks of envelopes in bidirectional operation. Bidirectional operation enables, among other advantages, envelopes to be deposited on the sequence stacker at its midpoint and stacked at either of its ends. To enable bidirectional operation and tight packing of the stacked envelopes, the sequence stacker of the present invention is equipped with some short spacers placed at intervals in the deck grooves under the belts. The spacers are located longitudinally along the grooves at intervals that suit the particular applications with which the sequence stacker will be used. The spacers are designed to maintain the top surfaces of the belt portions located over the spacers above the deck surface even with a full stack of envelopes on the belts. The result is that the belts continuously exert a driving force on the bottom edges of the envelopes that are located over the spacers. That driving force assures that the envelopes in the stack downstream of the spacers remain in a tight stack.

The short spacer design can also be used in the sequence stacker that employs the elongated spacer attached to the deck surface. In that case, the short spacers are designed with thicknesses that maintain the top surfaces of the belts at the portions thereof located over the short spacers above the upper surface of the elongated spacer even when the belt portions above the short spacers have a stack of envelopes on them.

The sequence stacker of the present invention enables large numbers of envelopes to be edge stacked before backward tipping occurs. The sequence stacker tightly packs long stacks of envelopes, and it is very versatile to suit different application requirements.

Other advantages, benefits, and features of the present invention will become apparent to those skilled in the art upon reading the detailed description of the invention.

BRIEF DESCRIPTION OF THE DRAWINGS

FIG. 4 is a cross sectional view taken along line 4—4 of FIG. 2.

FIG. 5 is a cross sectional view taken along line 5—5 of FIG. 3.

FIG. 6 is a view similar to FIG. 4, but showing a modified embodiment of the invention with only a few envelopes on the sequence stacker.

FIG. 7 is a view similar to FIG. 5, but showing the sequence stacker of FIG. 6 with a large quantity of envelopes thereon.

FIG. 11 is a cross sectional view taken along line 11—11 of FIG. 9.

FIG. 12 is a cross sectional view taken along line 12—12 of FIG. 10.

FIG. 13 is a cross sectional view similar to FIG. 5, but showing short belt-supporting spacers in combination with an elongated envelope-supporting spacer.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
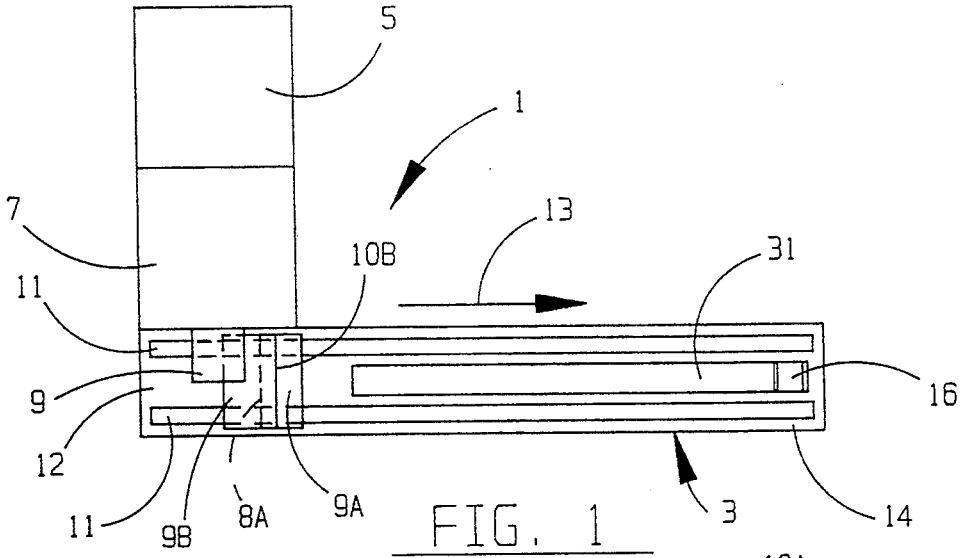
FIG. 1 is a simplified top view of the sequence stacker of the present invention in combination with other equipment for handling documents.

Referring to FIG. 1, a typical document processing system 1 is illustrated that includes a sequence stacker 3 according to the present invention. The document processing system 1 is particularly useful for stuffing envelopes with selected documents, addressing the envelopes, and otherwise preparing them for franking and mailing. However, it will be understood that the invention is not limited to envelope handling applications.

The particular document processing system 1 illustrated includes a stuffing and sealing machine generally indicated at reference numeral 5 and an addressing machine generally indicated at reference numeral 7, neither of which form any part of the present invention. Reference numeral 9 represents a stuffed, sealed, and addressed envelope as it emerges from the addressing machine 7. To quickly dry the ink applied to the envelopes by the addressing machine 7, a heater, not shown, may be placed above the envelopes 9 as they emerge from the addressing machine.

The envelopes 9 emerge from the addressing machine 7 over the upstream end 12 of the sequence stacker 3. The envelopes fall onto two or more horizontally oriented belts 11. The belts 11 carry the envelopes in a downstream direction represented by arrow 13 to the downstream end 14 of the sequence stacker. The timing of the addressing machine 7 and the belts 11 is such that the envelopes overlap on the belts. That is, the leading edge 10B of a subsequent envelope 9B emerging from the addressing machine 7 overlaps the trailing edge 8A of a preceding envelope 9A. Accordingly, the envelopes advance in the downstream direction 13 in shingled fashion. At the downstream end 14 of the sequence stacker is an angled stop 16. Side guides, not shown but well known in the art, are usually employed to guide the envelopes as they are carried by the belts along the sequence stacker to the stop 16.

In accordance with the present invention, the sequence stacker 3 is capable of edge stacking a much larger number of envelopes 9 than prior stacking machines. Looking also at FIGS. 2–5, the sequence stacker is comprised of a cabinet, not shown in detail, that rests on the work room floor. The cabinet has an elongated deck 15 with a horizontal top surface 17. Two belts 11 are shown, but more belts may be used if desired. The belts 11 are trained around respective upstream and downstream pulleys; only the downstream pulley 19 is shown. If desired, the belts can be trained directly around shafts rather than around pulleys. Each belt has an upper feed run 21 and a lower return run 23. The upper run 21 of each belt has a top surface 25 and a bottom surface 27. The top surface 25 and bottom surface 27 define the belt thickness t. Attached to the surface 17 of the deck 15 between the belts 11 is an elongated spacer 29. More than one elongated spacer 29 can be used if the sequence stacker employs more than two belts. The elongated spacer 29 has a thickness t1 and an upper surface 31. The thickness t1 of the elongated spacer is greater than the thickness t of the belts.

The downstream pulley 19, as well as the upstream pulley, are located relative to the deck 15 such that the bottom surfaces 27 of the belts 11 are located at a carefully controlled distance T above the deck surface 17. In the particular construction shown, the distance T is greater than the spacer thickness t1. That is, there is a distance t2 between the plane of the bottom surfaces of the belts and the elongated spacer upper surface 31. However, satisfactory results are also obtained if the distance T is less than the spacer thickness t1. In that case, the distance t2 disappears.

Figure 2:
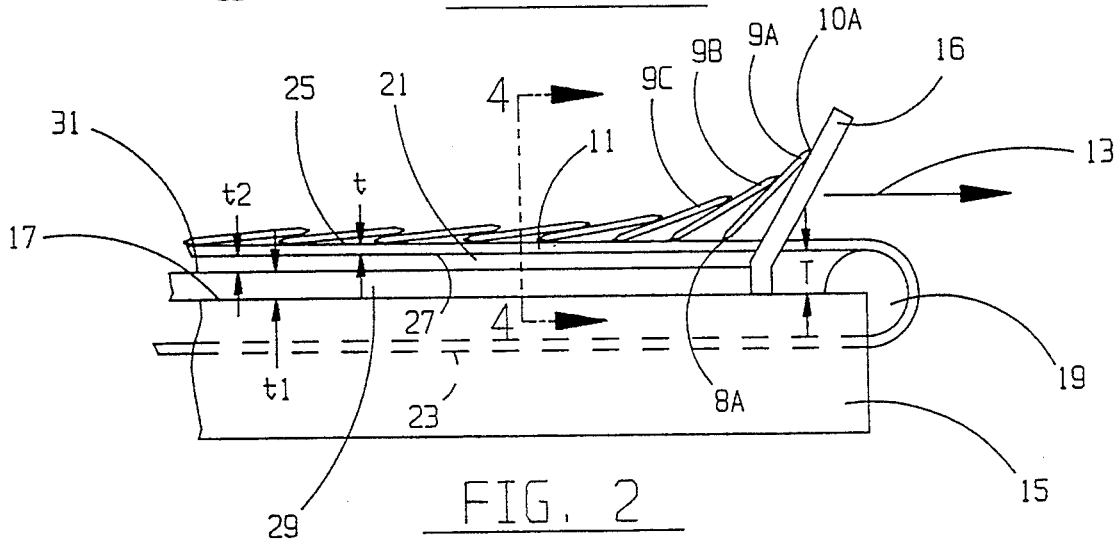
FIG. 2 is a partial side view on an enlarged scale of the sequence stacker of the present invention shown at the beginning of a stacking operation.
Figure 3:
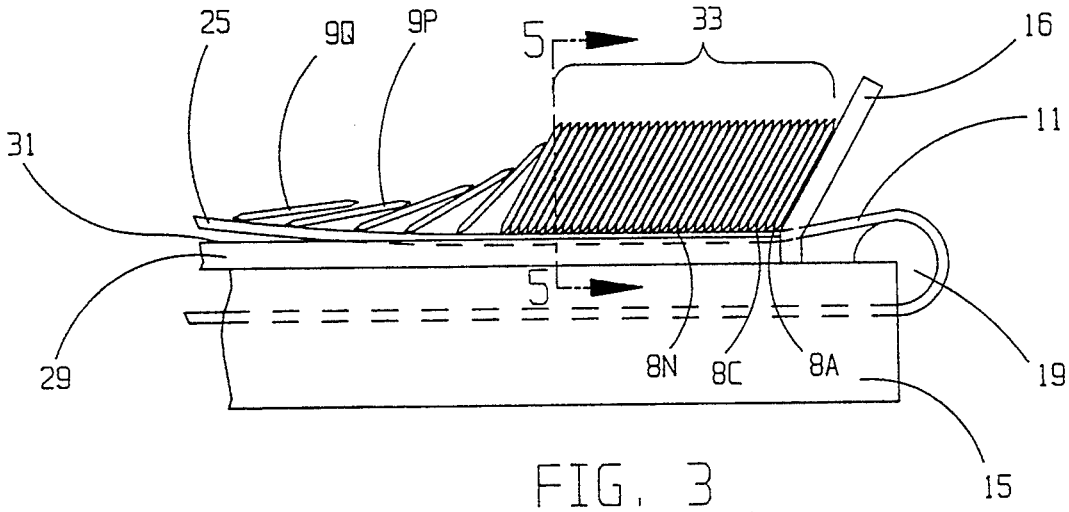
FIG. 3 is a view similar to FIG. 2, but showing the sequence stacker at a subsequent time during a stacking operation.

At the beginning of a run of stacking envelopes 9, the belts 11 are located relative to the deck 15 as is shown in FIGS. 2 and 4. That is, the bottom surfaces 27 of the belts' upper runs 21 are located at the distance T from the deck surface 17 for the full length of the belts between the sequence stacker upstream end 12 and its downstream end 14. As envelopes drop onto the belts in shingled fashion from the addressing machine 7, the envelopes are carried downstream to the stop 16. When the leading edge 10A of the first envelope 9A strikes the stop, friction between the belts and the envelope trailing edge 8A causes the envelope to ride up the stop. The subsequent envelope 9B rides up on envelope 9A, and additional subsequent envelopes ride up on the adjacent preceding envelopes to create an edge stack 33 of individual envelopes, FIG. 3.

As the number of envelopes 9 in the stack 33 increases, their weight causes the belts 11 to deflect. Also see FIG. 5. Such deflection causes the distances T and t2 to diminish. Eventually, the weight of the stack 33 is great enough to deflect the belts such that their top surfaces 25 become aligned with the upper surface 31 of the elongated spacer 29. At that point, no further deflection of the belts occurs, because the envelopes are then supported on the elongated spacer and not on the belts. Consequently, the friction force from the belts that urge the trailing or bottom edges 8 of the envelopes in the downstream direction 13 is greatly reduced or even eliminated, and the tendency of the envelopes to tip over backwardly in the upstream direction is also greatly diminished.

Upstream from the stack 33, where there is practically no weight on the belts 11 from incoming envelopes, such as envelopes 9P and 9Q, the belts do not deflect to the maximum amount. The belts' top surfaces 25 therefore remain above the upper surface 31 of the elongated spacer 29. As a result, the belts are able to carry the incoming envelopes represented by envelopes 9P and 9Q downstream to the stack without problem. We have found that the sequence stacker 3 is able to successfully stack more than triple the number of envelopes compared with prior stacking machines.

FIGS. 6 and 7 show a modified embodiment of the present invention. A sequence stacker 35 has a deck 37 with a horizontal surface 39. In the deck horizontal surface 39 are formed grooves 41 under corresponding belts 11'. The depth D of the grooves 41 is greater than the thickness t of the belts 11'. With no or only a few envelopes 9 on the belts 11', the bottom surfaces 27' of the belts are spaced a distance t2 above the deck surface 39. However, as envelopes stack up their weight causes the belts 11' to deflect until the belt top surfaces 25' become aligned with the deck surface 39. At that point, the envelope trailing or bottom edges 8 contact the deck surface, and the weight of the envelopes is transferred from the belts to the deck, FIG. 7. The grooves 41 receive the belts 11' without interference, thereby enabling the belts to operate in a normal fashion within the grooves. The portions of the belts 11' upstream from the stack are undeflected and rise out of the grooves. The belts are thus able to carry subsequent incoming envelopes to the stack.

Now turning to FIGS. 8–12, an exceptionally versatile sequence stacker 43 is depicted. The sequence stacker 43 is capable of bidirectional operation and also of creating long stacks of tightly packed envelopes. The sequence stacker 43 may be installed at different locations relative to the other components of a document processing system to suit different application requirements. The sequence stacker 43 has a deck 45 with a horizontal surface 46 and longitudinally extending grooves 47. A belt 49 is associated with each groove 47. The opposite ends of the belts 49 are trained over pulleys 51 such that the belts' upper runs 53 are directly above the associated grooves 47. The pulleys 51 are driven by known means to operate the belts 49 in either direction, so that either end of the sequence stacker 43 can be the upstream end or the downstream end. For purposes of illustration, it will be assumed that the end 55 of the sequence stacker 43 is the upstream end and the end 57 is the downstream end. Consequently, the pulleys 51 drive the belts 49 such that their respective upper runs 53 translate in the direction of arrow 59. An angled stop 60 is at the sequence stacker downstream end 57.

Each belt 49 has a thickness t defined by a top surface 61 and a bottom surface 63 of the belt upper run 53. The grooves 47 have a depth D greater than the dimension t. The pulleys 51 are located such that the bottom surfaces 63 of the belts' upper runs 53 are at a distance t2 above the deck surface 46 when there are no or only a few envelopes 9 on the belts, FIGS. 9 and 11.

Further in accordance with the present invention, the sequence stacker 43 is able to tightly pack a long stack of envelopes 9 while operating in either direction. For that purpose, a series of short spacers are placed in the deck grooves 47. In the illustrated construction, there is a center spacer 65 and a pair of end spacers 67 and 68 in each groove, but the number and location of the short spacers will vary with the particular deck configuration. The spacers 67 and 68 have a thickness t3 that is less than the depth D of the grooves 47. Further, the sum of the spacer thickness t3 and the belt thickness t is greater than the depth D of the grooves. Preferably, the center spacers 65 have a slightly lesser thickness t4 than the thickness t3 of the end spacers 67 and 68. However, the sum of the thicknesses t4 and t is greater than the groove depth D.

Figure 8:
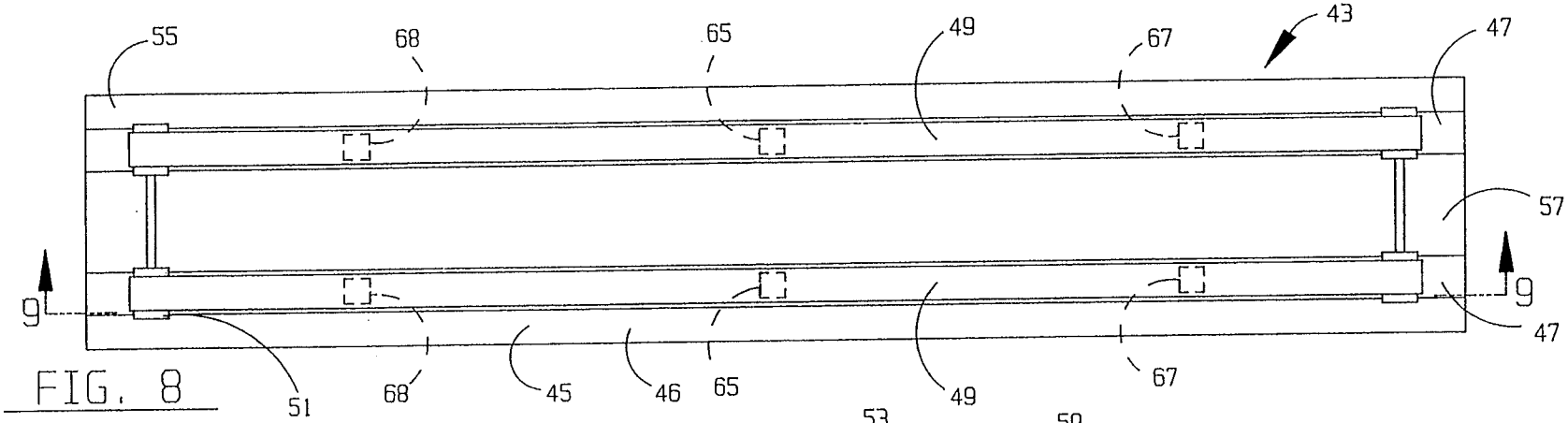
FIG. 8 is a simplified top view of a sequence stacker that is capable of bidirectional operation.
Figure 9:
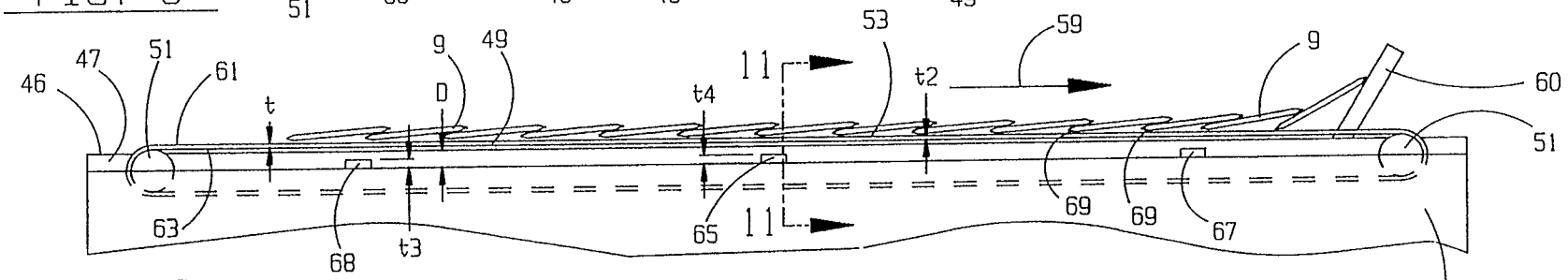
FIG. 9 is a cross sectional view taken along line 9—9 of FIG. 8 showing the sequence stacker at the start of a stacking operation.
Figure 10:
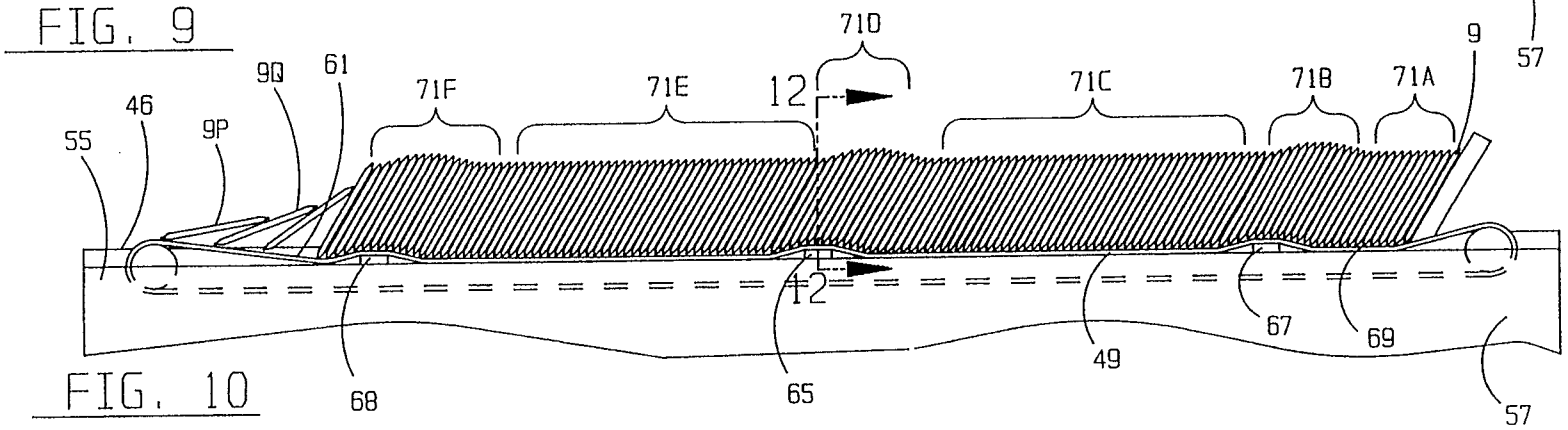
FIG. 10 is a cross sectional view similar to FIG. 9, but showing the sequence stacker at a subsequent time during the stacking operation.

In operation, the sequence stacker 43 accepts envelopes 9 from an addressing machine or similar equipment. FIGS. 8 and 10 show the envelopes being deposited on the sequence stacker at its upstream end 55 and carried in the direction of arrow 59 to the downstream end 57. As discussed previously, end 57 could be the upstream end and end 55 could be the downstream end if required. Moreover, the versatility of the sequence stacker 43 is such that the envelopes could, if desired, be deposited at the center of the sequence stacker and then carried in either direction to the desired downstream end.

At the beginning of a stacking operation, when only a few envelopes 9 are on the belts 49, the belts' top surfaces 61 are located above the deck surface 46. The belts carry the envelopes to the angled stop 60 to form a stack 71A. The weight of the stack 71A causes the belts 49 to deflect until the envelopes' bottom edges 69 become supported on the deck surface 46 rather than on the belts. Consequently, the driving force on the envelopes' bottom edges 69 is considerably reduced, as is the tendency for the stack to tip backwardly in the upstream direction.

At the locations of the spacers 65, 67, and 68, the spacers maintain the top surfaces 61 of the belts 49 above the deck surface 46. Consequently, for a short portion of the belts over the spacers 67, the weight of the stack 71B is not transferred to the deck surface 46. Rather, the belts continue to contact and urge downstream the envelopes in the stack 71B. The result is that the stack 71A is pushed in the downstream direction by the stack 71B. The envelopes 9 of the stack 71A are thus maintained in a tight stack despite the fact that the individual envelopes 9 in the stack 71A are not urged downstream by the belts. The same situation exists for the stacks 71C and 71E. The envelopes in those stacks are not individually urged downstream by the belts. Nevertheless, the envelopes in those stacks are tightly packed by the respective adjacent upstream stacks 71D and 71F. That is because the stacks 71D and 71F are located over the short spacers 65 and 68, respectively. Consequently, the belts continuously exert a downstream driving force on the envelopes in those stacks.

At the upstream end 55 of the sequence stacker 43, where only a few envelopes, such as envelopes 9P and 9Q, are on the belts 49, the belts undergo little if any deflection. Consequently, their top surfaces 61 remain above the deck surface 46. The belts are thus able to carry incoming envelopes to the stack 71F in a normal fashion. In that manner, the sequence stacker 43 is capable of tightly stacking a large number of envelopes without backward tipping.

In the embodiment of FIG. 13, a sequence stacker 73 employs a deck 15' with a horizontal planar surface 17'. An elongated spacer 29' is attached to the surface 17' of the deck 15'. Belts 11' carry envelopes 9' in a downstream direction. The deck 15', belts 11', and elongated spacer 29' are substantially similar to the respective components of the sequence stacker 3 described previously in conjunction with FIGS. 2–5.

The sequence stacker 73 further comprises several short spacers 75. The short spacers 75 are similar to the short spacers 65, 67, and 68 used with the sequence stacker 43 of FIGS. 8–12. That is, the short spacers 75 have respective upper surfaces 77 that are at a lesser distance from the deck surface 17' than the upper surface 31' of the elongated spacer 29'. The thickness of the short spacers 75 is chosen so that when the belts 11' are deflected under the weight of the envelopes 9', the top surfaces 25' of the belts 11' remain above the upper surface 31' of the elongated spacer 29'. Consequently, for the length of the short spacers 75, the weight of the envelopes 9' is not transferred to the elongated spacer 29'. Rather, the belts continue to produce a downstream force on the bottom edges 8' of the envelopes located over the short spacers 75 in a manner similar to the operating characteristics of the sequence stacker 43 described in conjunction with FIGS. 8–12.

Thus, it is apparent that there has been provided, in accordance with the invention, a sequence stacker that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A sequence stacker comprising:

a. an elongated deck having a horizontal surface that defines a deck plane and that defines and extends between a deck upstream end and a downstream end;

b. a plurality of belts having thicknesses defined by top and bottom surfaces that lie in respective planes parallel to the deck horizontal surface, the top surfaces of the belts being spaced a first predetermined distance above the deck horizontal surface, the bottom surfaces of the belts cooperating with the deck plane to define respective generally rectangular spaces therebetween that extend substantially continuously between the deck upstream and downstream ends;

c. pulley means located at the deck upstream and downstream ends for driving the belts in a downstream direction;

d. at least one elongated first spacer attached to the deck horizontal surface proximate the belts and located outside of the rectangular spaces defined by the bottom surfaces of the belts and the deck plane, the first spacer having a downstream end and a thickness greater than the thickness of the belts, the first spacer having an upper surface that is at a second predetermined distance above the deck horizontal surface less than the first predetermined distance; and e. an angled stop at the downstream end of the first spacer, so that the belts can carry shingled envelopes in the downstream direction and stack them against the angled stop with the weight of the stack being sufficient to deflect the belts until the top surfaces thereof become aligned with the upper surface of the first spacer to thereby transfer the weight of the stack from the belts to the first spacer and cause the belts to decrease downstream driving force on the stack.

2. The sequence stacker of claim 1 wherein the bottom surfaces of the belts are spaced at a third predetermined distance above the deck surface greater than the second predetermined distance when there is not a stack of envelopes on the belts.

3. A sequence stacker comprising:

a. an elongated deck having a horizontal planar surface;

b. a plurality of belts having thicknesses defined by top and bottom surfaces that lie in respective planes parallel to the deck horizontal surface, the top surfaces of the belts being spaced a first predetermined distance above the deck horizontal surface;

c. pulley means for driving the belts in a downstream direction;

d. at least one elongated first spacer attached to the deck horizontal surface proximate the belts, the first spacer having a downstream end and a thickness greater than the thickness of the belts, the first spacer having an upper surface that is at a second predetermined distance above the deck horizontal surface less than the first predetermined distance;

e. an angled stop at the downstream end of the first spacer; and f. at least one short second spacer under each belt, each second spacer having an upper surface that is spaced at a fourth predetermined distance less than the second predetermined distance above the deck horizontal surface, the upper surfaces of the short second spacers contacting and cooperating with the bottom surfaces of the respective belts when the belts deflect under the weight of the stack located above the second spacers to maintain the top surfaces of the belts located above the second spacers at a distance greater than the second predetermined distance above the deck horizontal surface, so that the belts can carry shingled envelopes in the downstream direction and stack them against the angled stop with the weight of the stack being sufficient to deflect the belts until the top surfaces thereof become aligned with the upper surface of the first spacer to thereby transfer the weight of the stack from the belts to the first spacer and cause the belts to decrease downstream driving force on the stack, and so that the belts continuously exert a downstream driving force on the portions of the stack located above the second spacers.

4. In combination with an envelope processing machine that drops envelopes horizontally, apparatus for stacking the envelopes comprising:

a. an elongated deck defining a deck plane and having an upstream end and a downstream end;

b. an elongated spacer attached to the deck and extending between the upstream and downstream ends thereof, the elongated spacer having an upper surface located at a first predetermined distance above the deck and generally parallel to the deck plane;

c. an angled stop located at the deck downstream end; and d. belt means for receiving the envelopes dropped by the envelope processing machine and carrying them in shingled fashion downstream from the deck upstream end to the angled stop to be formed into a stack thereat, and for deflecting under the weight of the stack to transfer the weight of the stack to the elongated spacer and thereby reduce downstream driving force by the belt means on the stack, the belt means comprising at least two belts proximate the elongated spacer and having respective top and bottom surfaces, the elongated spacer being located entirely outside generally rectangular spaces defined by the cooperation of the deck plane and the bottom surfaces of the respective belts, the top surface of each belt being spaced above the deck a distance greater than the first predetermined distance at locations upstream from the stack and being spaced above the deck at a distance equal to the first predetermined distance at locations under the stack to thereby transfer the weight of the stack from the belts to the elongated spacer.

5. In combination with an envelope processing machine that drops envelopes horizontally, apparatus for stacking the envelopes comprising:

a. an elongated deck having an upstream end and a downstream end;

b. an elongated spacer attached to the deck and extending between the upstream and downstream ends thereof, the elongated spacer having an upper surface located at a first predetermined distance above the deck;

c. an angled stop located at the downstream end of the elongated spacer;

d. belt means for receiving the envelopes dropped by the envelope processing machine and carrying them in shingled fashion downstream from the deck upstream end to the angled stop to be formed into a stack thereat, and for deflecting under the weight of the stack to transfer the weight of the stack to the elongated spacer and thereby reduce the downstream driving force by the belt means on the stack, wherein the belt means comprises at least two belts proximate the elongated spacer and having respective top and bottom surfaces, the top surface of each belt being spaced above the deck a distance greater than the first predetermined distance at locations upstream from the stack and being spaced above the deck at a distance equal to the first predetermined distance at locations under the stack to thereby transfer the weight of the stack from the belt to the elongated spacer; and e. at least one short spacer attached to the deck under each belt, each short spacer having an upper surface that is at a distance less than the first predetermined distance above the deck and that cooperates with the associated belt to maintain the top surface thereof at a distance greater than the first predetermined distance above the deck to thereby prevent transfer of the weight of the portion of the stack located over the short spacer from the belt to the elongated spacer, so that the belts continuously exert a downstream driving force on the envelopes in the portions of the stack located above the short spacers.

6. apparatus for stacking envelopes comprising:

a. an elongated planar deck defining a plurality of longitudinally extending grooves;

b. an angled stop on the deck;

c. belt means for traveling in a downstream direction above the deck to carry the envelopes generally horizontally downstream and form a stack of envelopes at the angled stop, and for deflecting into the deck grooves under the weight of the stack to transfer the weight of the stack from the belt means to the deck and thereby reduce the driving force of the belt means on the stack; and d. spacer means for preventing the belt means from transferring the weight of the stack onto the deck at predetermined locations along the deck grooves.

7. Apparatus for stacking envelopes comprising:

a. an elongated planar deck defining a plurality of longitudinally extending grooves;

b. an angled stop on the deck;

c. belt means for traveling in a downstream direction above the deck to carry the envelopes generally horizontally downstream and form a stack of envelopes at the angled stop, and for deflecting into the deck grooves under the weight of the stack to transfer the weight of the stack from the belt means to the deck and thereby reduce the driving force of the belt means on the stack, wherein the belt means comprises a plurality of belts located generally above respective deck grooves, each belt having a top surface and a bottom surface that cooperate to define a belt thickness, the belts' top surfaces being located a first predetermined distance above the deck upstream from the stack and being aligned with the deck under the stack to transfer the weight of the stack from the belts to the deck; and d. at least one spacer attached to each deck groove, each spacer having an upper surface that lies below the plane of the deck, the spacer upper surface cooperating with the bottom surface of the associated belt for the portion thereof located over the spacer to prevent the belt top surface thereat from deflecting into alignment with the deck, so that the belts continuously exert a driving downstream force on the portion of the stack located over the spacer.

8. A method of stacking envelopes comprising the steps of:

a. carrying shingled envelopes downstream on the top surfaces of belts over a deck, the belts and the deck defining respective spaces therebetween;

b. forming the shingled envelopes into a stack;

c. providing a spacer having a top surface;

d. locating the spacer adjacent the belts and outside of the respective spaces between the belts and the deck;

e. deflecting the belts under the stack into a lined relation with the belts' top surfaces and the spacer upper surface and thereby transferring the weight of the stack of envelopes from the belts to the spacer; and f. continuing to carry shingled envelopes downstream on the belts to the stack.

9. A method of edge stacking a large quantity of envelopes comprising the steps of:

a. carrying envelopes in a downstream direction on the top surfaces of belts;

b. forming the envelopes into an edge stack on the belts and exerting a downstream driving force by the belts on the stack;

c. transferring the weight of selected first portions of the stack from the belts onto a first stationary surface and thereby reducing the driving force of the belts on the first portions of the stack;

d. continuing to carry envelopes downstream on the belts to the stack; and e. continuing to exert a downstream driving force on selected second portions of the stack with the belts, wherein the step of continuing to exert a downstream driving force on selected second portions of the stack comprises the steps of:

i. providing coplanar second stationary surfaces under the selected second portions of the stack;

ii. locating the first stationary surface in a plane lying between the second stationary surfaces and the top surfaces of the belts;

iii. deflecting the belts under the selected second portions of the stack;

iv. supporting the belts under the selected second portions of the stack with the second stationary surfaces; and v. maintaining the top surfaces of the belts under the selected second portions of the stack in a plane located above the first stationary surface and preventing transfer of the weight of the selected second portions of the stack to the first stationary surface.

10. A method of edge stacking a large quantity of envelopes comprising the steps of:

a. carrying envelopes in a downstream direction on the top surfaces of belts;

b. forming the envelopes into an edge stack on the belts and exerting a downstream driving force by the belts on the stack;

c. transferring the weight of selected first portions of the stack from the belts onto a first stationary surface and thereby reducing the driving force of the belts on the first portions of the stack;

d. continuing to carry envelopes downstream on the belts to the stack; and e. continuing to exert a downstream driving force on selected second portions of the stack with the belts, wherein the step of continuing to exert a downstream driving force on selected second portions of the deck comprises the steps of:

i. providing coplanar second stationary surfaces under the selected second portions of the stack, wherein the step of providing second stationary surfaces under the selected second portions of the stack comprises the steps of:

providing a grooved deck with a horizontal surface;

attaching spacers having respective coplanar upper surfaces in the deck grooves; and locating the deck horizontal surface between the upper surfaces of the spacers and the top surfaces of the belts;

ii. locating the first stationary surface in a plane lying between the second stationary surfaces and the top surfaces of the belts;

iii. deflecting the belts under the selected second portions of the stack, wherein the step of deflecting the belts under the selected second portions of the stack comprises the steps of:

contacting the belts with the upper surfaces of the associated spacers; and maintaining the deck surface between the upper surfaces of the spacers and the top surfaces of the belts;

iv. supporting the belts under the selected second portions of the stack with the second stationary surfaces; and v. maintaining the top surfaces of the belts under the selected second portions of the stack in a plane located above the first stationary surface and preventing transfer of the weight of the selected second portions of the stack to the first stationary surface.

* * * * *